US009293008B2

(12) United States Patent
Barclay et al.

(10) Patent No.: US 9,293,008 B2
(45) Date of Patent: Mar. 22, 2016

(54) LAYOUT ELEMENTS AS RENDERING PLACEHOLDERS FOR NATIVE WAGERING GAME APPLICATIONS

(71) Applicant: WMS Gaming, Inc., Waukegan, IL (US)

(72) Inventors: Brian J. Barclay, Atlanta, GA (US); Patrick Childers, Marietta, GA (US); Dedrick W. Duckett, Canton, GA (US); Edward Q. Earley, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 293 days.

(21) Appl. No.: 13/797,338

(22) Filed: Mar. 12, 2013

(65) Prior Publication Data

US 2013/0244777 A1 Sep. 19, 2013

Related U.S. Application Data

(60) Provisional application No. 61/611,631, filed on Mar. 16, 2012.

(51) Int. Cl.
*G07F 17/32* (2006.01)

(52) U.S. Cl.
CPC ..... *G07F 17/326* (2013.01)

(58) Field of Classification Search
CPC ..... G07F 17/326
See application file for complete search history.

(56) References Cited

U.S. PATENT DOCUMENTS

| | | | | |
|---|---|---|---|---|
| 7,392,470 | B2 | 6/2008 | Kammler | |
| 7,543,225 | B2 | 6/2009 | Kammler | |
| 7,618,317 | B2 | 11/2009 | Jackson | |
| 7,966,371 | B2 | 6/2011 | Mao et al. | |
| 8,291,332 | B2 | 10/2012 | Chaudhri et al. | |
| 2004/0009813 | A1* | 1/2004 | Wind | 463/30 |
| 2004/0225960 | A1* | 11/2004 | Parikh | G06F 8/38 715/243 |
| 2004/0229699 | A1 | 11/2004 | Gentles et al. | |
| 2006/0100011 | A1* | 5/2006 | Morrow | G07F 17/32 463/29 |
| 2006/0183527 | A1* | 8/2006 | Honour | G07F 17/32 463/13 |
| 2009/0144610 | A1 | 6/2009 | Sheldon | |
| 2011/0009195 | A1* | 1/2011 | Porwal | A63F 13/06 463/37 |

OTHER PUBLICATIONS

"Working with the new CSS starter layouts in Adobe Dreamweaver CS5" published by Tommi West on or before Aug. 31, 2010, accessible and printed from URL <http://www.adobe.com/inspire-archive/august2010/articles/article5/index.html?trackingid=HRTDM>, 7 pages.*

"Machine code", *Wikipedia* http://en.wikipedia.org/wiki/Machine_code Date Obtained from the Internet: Mar. 30, 2012 Last Date Modified: Mar. 26, 2012, 4 pages.

"Web Browser Engine", *Wikipedia* http://en.wikipedia.org/wiki/Layout_engine Date Obtained from the Internet: Mar. 30, 2012 Last Date Modified: Mar. 19, 2012, 2 pages.

W3C,, "XHTML Basic 1.1-Second Edition", *W3C Recommendation* Nov. 23, 2010 http://www.w3.org/TR/2010/REC-xhtml-basic-20101123/ Date Obtained from the Internet: Mar. 30, 2012 Nov. 23, 2010, pp. 1-29.

* cited by examiner

*Primary Examiner* — Jason Skaarup
(74) *Attorney, Agent, or Firm* — DeLizio Law, PLLC

(57) ABSTRACT

A wagering game machine configured to present a wagering game upon which monetary value may be wagered receives a layout description for a first set of image components defines one or more placeholder areas. A first executable component renders a portion of the first set of image components in accordance with the layout description. A natively executed wagering game application renders a second set of image components defined independently from the layout description within the placeholder areas. The first executable component renders a second portion of the first set of images over the images rendered by the natively executed wagering game application.

26 Claims, 11 Drawing Sheets

```
a.   <img src="ag://services/asset/game/SuperTeam1/assetname/PL_TEXT_pitch_bullets.png"  alt="Instructables">
b.   <video poster="ag://services/asset/game/SuperTeam1/assetname/movie.jpg" controls>
        <source src='ag://services/asset/game/SuperTeam1/assetname/movie.webm' type='video/webm; codecs="vp8.0, vorbis"'/>
        <source src='ag://services/asset/game/SuperTeam1/assetname/movie.ogv' type='video/ogg; codecs="theora, vorbis"'/>
        <source src='ag://services/asset/game/SuperTeam1/assetname/movie.mp4' type='video/mp4; codecs="avc1.4D401E, mp4a.40.2"'/>
        <p>This is fallback content</p>
     </video>
```

902

904

FIG. 9

LAYOUT ELEMENTS AS RENDERING PLACEHOLDERS FOR NATIVE WAGERING GAME APPLICATIONS

RELATED APPLICATIONS

This application claims the priority benefit of U.S. Provisional Application Ser. No. 61/611,631 filed Mar. 16, 2012.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2012, WMS Gaming, Inc.

FIELD

Embodiments of the inventive subject matter relate generally to wagering game systems, and more particularly to wagering game systems including native game application rendered within placeholders established by layout elements.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

BRIEF DESCRIPTION OF THE FIGURES

Embodiments of the invention are illustrated in the Figures of the accompanying drawings in which:

FIG. 9 illustrates example layout language elements.

DESCRIPTION OF THE EMBODIMENTS

This description of the embodiments is divided into five sections. The first section provides an introduction to embodiments of the invention, while the second section describes example wagering game machine architectures. The third section describes example operations performed by some embodiments and the fourth section describes example wagering game machines in more detail. The fifth section presents general comments.

Introduction

This section provides an introduction to some embodiments of the invention. In general, the embodiments include novel systems and methods for combining the versatility of a layout language while supporting legacy software applications such as wagering game applications. A layout language includes a first set of graphical elements such as background elements. Placeholder elements in the layout language reserve space for rendering graphical images provided by native application code (e.g., native wagering game code). The layout language further includes other graphical elements and applications that can display over the placeholder areas. The inventive systems and methods thus provide a way to specify a desired layering of graphical elements that come from multiple sources where one of the sources is a native application.

Example Wagering Game Machine

Figure 1:
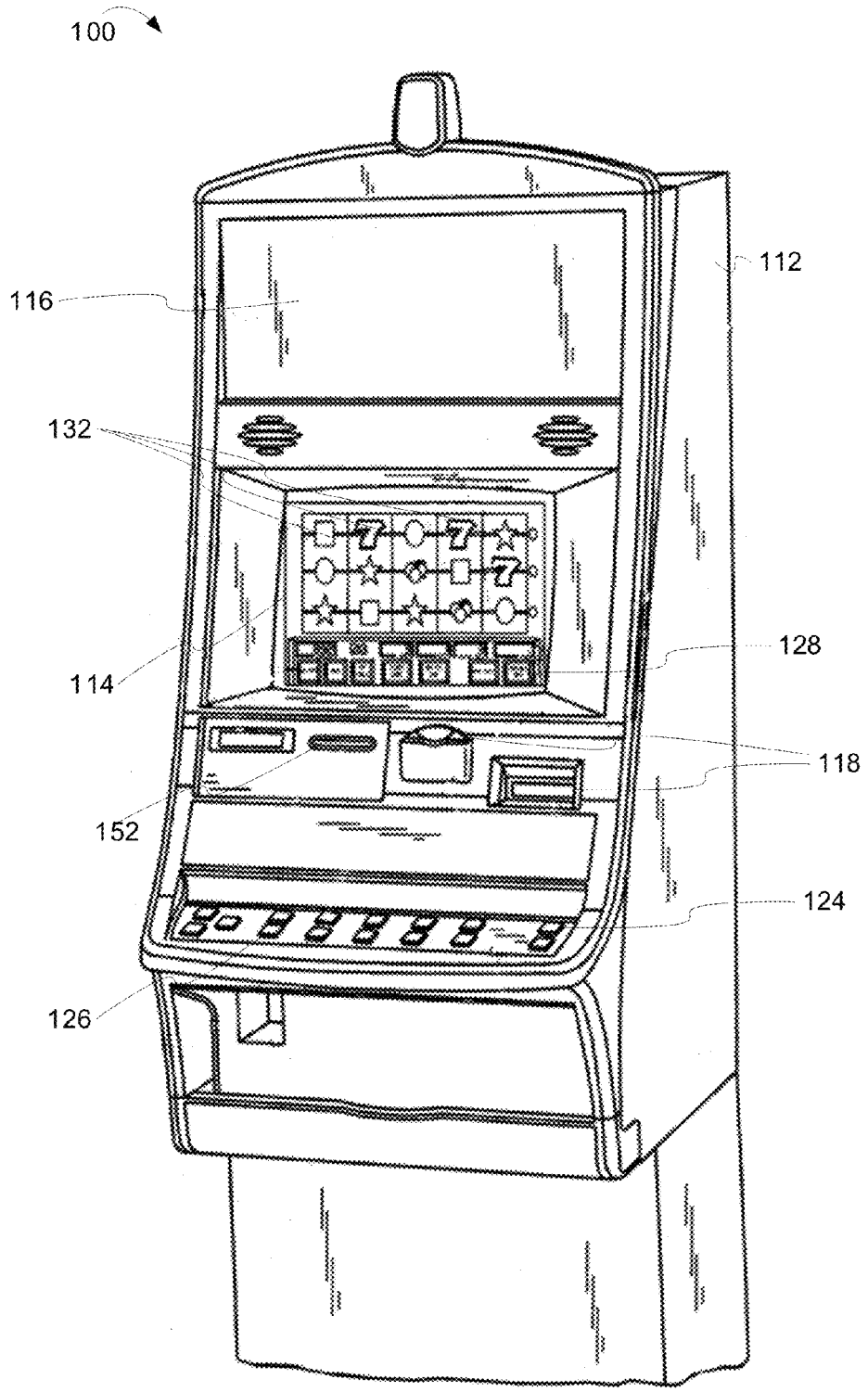
FIG. 1 is a perspective view of a wagering game machine, according to example embodiments of the invention.

FIG. 1 is a perspective view of a wagering game machine, according to example embodiments of the invention. Referring to FIG. 1, a wagering game machine 100 is used in gaming establishments, such as casinos. According to embodiments, the wagering game machine 100 can be any type of wagering game machine and can have varying structures and methods of operation. For example, the wagering game machine 100 can be an electromechanical wagering game machine configured to play mechanical slots, or it can be an electronic wagering game machine configured to play video casino games, such as blackjack, slots, keno, poker, blackjack, roulette, etc.

The wagering game machine 100 comprises a housing 112 and includes input devices, including value input devices 118 and a player input device 124. For output, the wagering game machine 100 includes a primary display 114 for displaying information about a basic wagering game. The primary display 114 can also display information about a bonus wagering game and a progressive wagering game. The wagering game machine 100 also includes a secondary display 116 for displaying wagering game events, wagering game outcomes, and/or signage information. While some components of the wagering game machine 100 are described herein, numerous other elements can exist and can be used in any number or combination to create varying forms of the wagering game machine 100.

The value input devices 118 can take any suitable form and can be located on the front of the housing 112. The value input devices 118 can receive currency and/or credits inserted by a player. The value input devices 118 can include coin acceptors for receiving coin currency and bill acceptors for receiving paper currency. Furthermore, the value input devices 118 can include ticket readers or barcode scanners for reading information stored on vouchers, cards, or other tangible portable storage devices. The vouchers or cards can authorize access to central accounts, which can transfer money to the wagering game machine 100.

The player input device 124 comprises a plurality of push buttons on a button panel 126 for operating the wagering game machine 100. In addition, or alternatively, the player input device 124 can comprise a touch screen 128 mounted over the primary display 114 and/or secondary display 116.

The various components of the wagering game machine 100 can be connected directly to, or contained within, the housing 112. Alternatively, some of the wagering game machine's components can be located outside of the housing 112, while being communicatively coupled with the wagering game machine 100 using any suitable wired or wireless communication technology.

The operation of the basic wagering game can be displayed to the player on the primary display 114. The primary display 114 can also display a bonus game associated with the basic wagering game. The primary display 114 can include a cathode ray tube (CRT), a high resolution liquid crystal display (LCD), a plasma display, light emitting diodes (LEDs), or any other type of display suitable for use in the wagering game machine 100. Alternatively, the primary display 114 can include a number of mechanical reels to display the outcome. In FIG. 1, the wagering game machine 100 is an "upright" version in which the primary display 114 is oriented vertically relative to the player. Alternatively, the wagering game machine can be a "slant-top" version in which the primary display 114 is slanted at about a thirty-degree angle toward the player of the wagering game machine 100. In yet another embodiment, the wagering game machine 100 can exhibit any suitable form factor, such as a free standing model, bartop model, mobile handheld model, or workstation console model.

Figure 10:
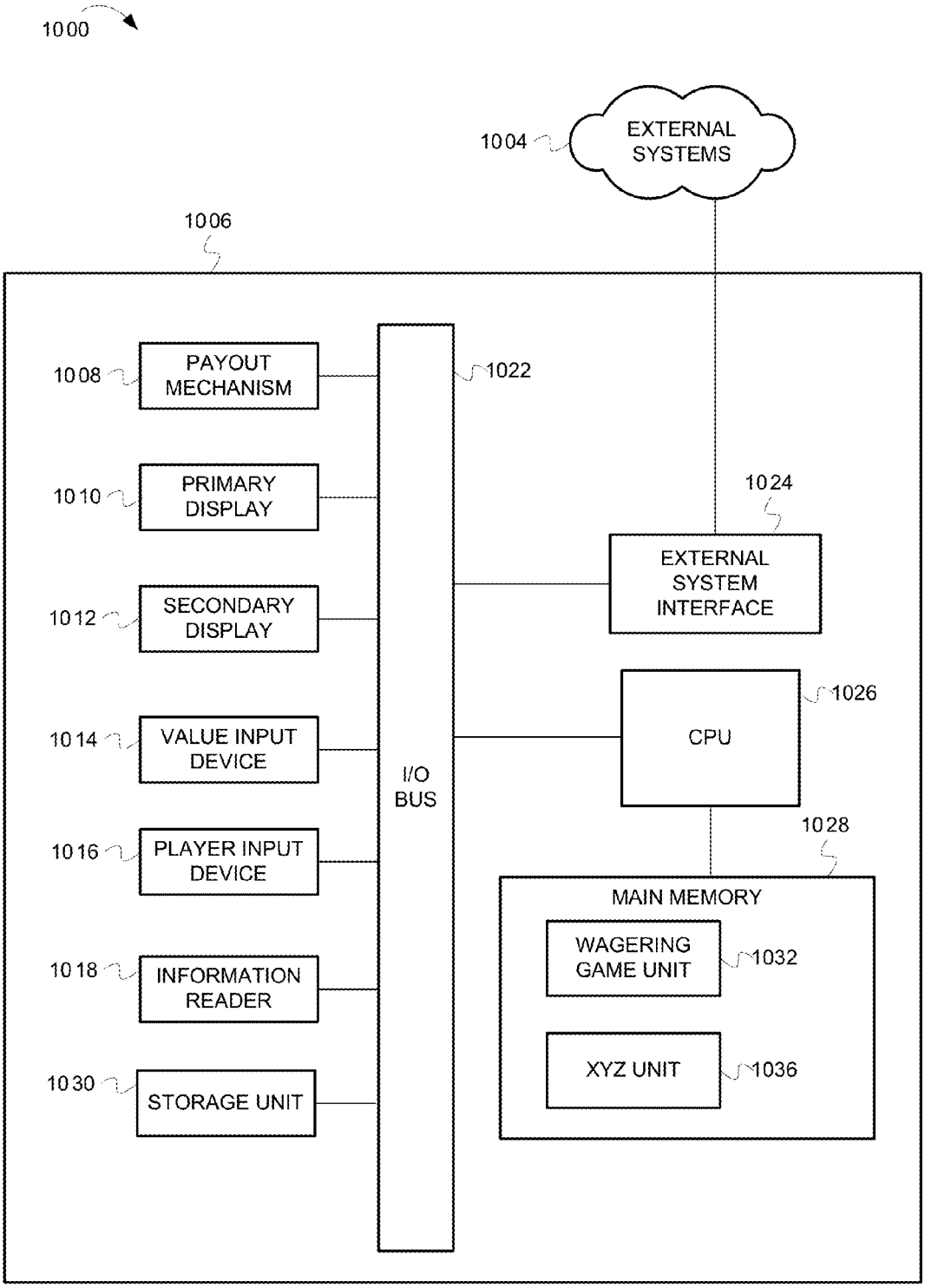
FIG. 10 is a block diagram illustrating a wagering game machine architecture, according to example embodiments of the invention.

A player begins playing a basic wagering game by making a wager via the value input device 118. The player can initiate play by using the player input device's buttons or touch screen 128. The basic game can include arranging a plurality of symbols along a payline 132, which indicates one or more outcomes of the basic game. Such outcomes can be randomly selected in response to player input. At least one of the outcomes, which can include any variation or combination of symbols, can trigger a bonus game. A player may receive a payout from the credit balance in response to providing a cashout input using the player input device's buttons or touchscreen 128. The payout can be provided by payout mechanism 1008 (FIG. 10).

In some embodiments, the wagering game machine 100 can also include an information reader 152, which can include a card reader, ticket reader, bar code scanner, RFID transceiver, or computer readable storage medium interface. In some embodiments, the information reader 152 can be used to award complimentary services, restore game assets, track player habits, etc.

Figure 2:
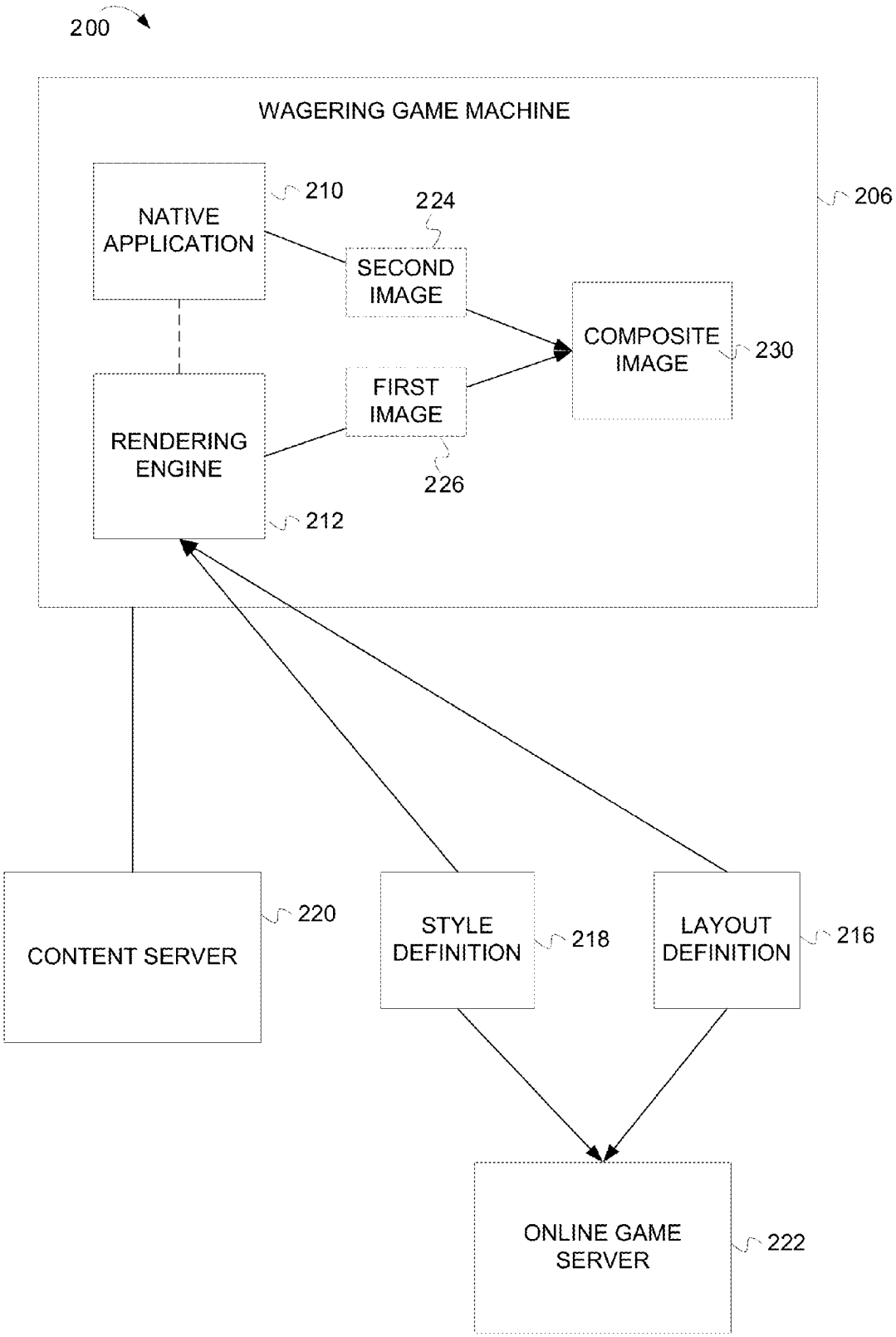
FIG. 2 is a block diagram of a system according to embodiments.

FIG. 2 is a block diagram of a system 200 according to embodiments. The system includes wagering game machine 100 having a first executable component that may be a rendering engine 212 and a second executable component that may be a native application 210. System 200 also includes a layout definition 216. Further, system 200 may include in some embodiments a style definition 218. Other components in various embodiments may include either or both a content server 220 and an online game server 222.

Native application 210 may be a basic wagering game. As discussed above, a basic wagering game may be a video casino game, such as blackjack, slots, keno, poker, blackjack, roulette, etc. Application 210 is referred to as a "native" application because it runs natively or directly on one or more processors in the wagering game machine and is not interpreted code run within an interpreter environment such as Adobe Flash, Java, or other interpreter based runtime environment.

Rendering engine 212 receives graphical commands and data and translates the commands and data into graphical images that can be displayed on a display such as display 114 or display 116 of wagering game machine 100. The rendering commands and data may come from various sources. In some embodiments, the commands and data comply with a version of HTML (HyperText Markup Language). In particular embodiments, rendering engine 212 comprises a version of Internet Explorer rendering engine modified to support additional commands and data structures to provide placeholders in the composite image produced by rendering engine 212 and native application 210.

The commands and data may be provided in whole or in part by layout definition 216. Layout definition 216 may be a file or data structure in a database that has commands and data defining the content, and potentially the layout, arrangement or visual characteristics of graphical elements for a composite image 230 that includes image date from content specified in the layout definition 216 and content provided by a native application 210. In some embodiments, layout definition 216 complies with a version of HTML.

In some embodiments, a layout definition 218 may also provide commands and data that control the layout and presentation of graphical elements on a display 114. In some embodiments, style definition 218 may comply, at least in part, with a style sheet standard such as a CSS (Cascading Style Sheet) language. In such embodiments, style definition 218 provides commands and data that affect how content specified in layout definition 216 is arranged in a composite image 230 that is displayed display 114.

In operation, wagering game machine 100 executes rendering engine 212 and native application 210. Rendering application 212 renders content specified by layout definition 216 to composite image 230 in accordance with layout commands specified by style definition 218. The image produced according to such content commands and layout commands is referred to as first image 226 in FIG. 2.

The commands and data provided by layout definition 216 and style definition 218 include commands that define one or more "placeholder" areas within first image 224. In essence, a placeholder area is an area within the first image that is reserved, i.e., left blank for use by native application 210.

Native application 210 generates a second image 226. The second image 226 is rendered within the placeholder areas defined by layout definition 216 or style definition 218. In some embodiments, native application 210 communicates with rendering engine 212 to receive display parameters for the placeholder areas such as the position and size of the placeholder areas. In some embodiments the communication may take place using a socket paradigm. Alternative embodiments may use other forms of inter-process communication know in the art. The display parameters for the placeholder areas may be pulled by native application 210 from rendering engine 212, or the display parameters may be pushed from rendering engine 212 to native application 210. The display parameters are then used by native application 210 to ensure that images produced by native application 210 are rendered within the placeholder areas reserved in composite image 230.

In some embodiments, some or all of the content executed and displayed on wagering game machine 100 may come from a content server 220. Content server 220 may provide executable for games, applications, or other executables running on wagering game machine 100. Further, audio, video, image data and other data such as graphics for symbols, tokens, icons, menus etc. may be provided by content server 220.

Although shown outside of content server 120 and wagering game machine 100, layout definition 216 and style definition 218 may reside on either or both of content server 220 or wagering game machine 100.

In some embodiments, online game server 222 operates to provide online games to client computers (not shown) such as personal computer, laptop computers, mobile phones, music players etc. The online games may be non-wagering versions of wagering games presented on wagering game machine 100. In such embodiments, the online game server 222 may used the same content and layout definition data to provide a uniform display of the content of a game.

Figure 3:
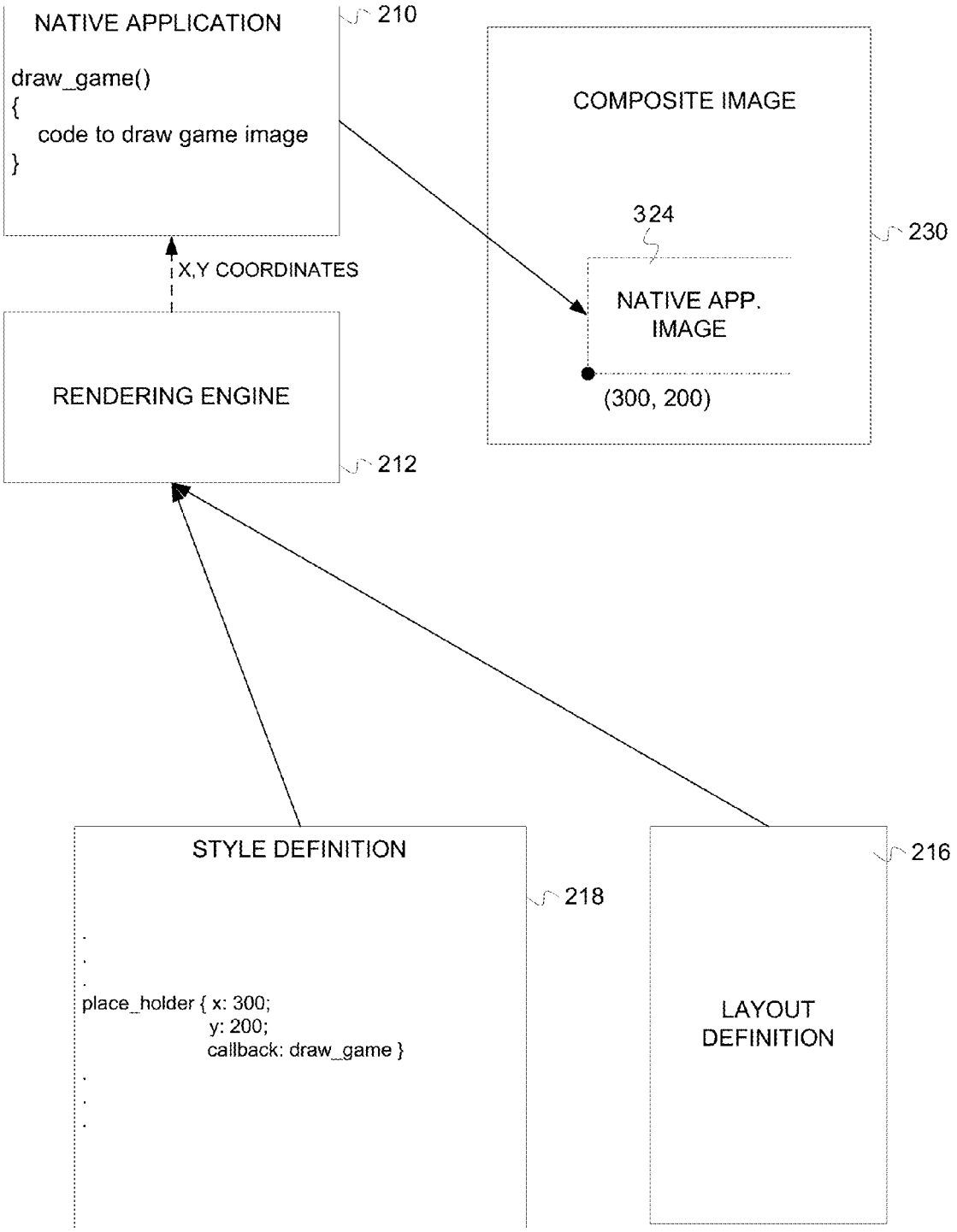
FIG. 3 provides further details on the components of FIG. 2.

FIG. 3 is a block diagram providing further details on the components of FIG. 2 according to some embodiments. As noted above, style definition 218 may be used to specify certain aspects of a placeholder area, such as the position, size and transparency parameters for the placeholder areas. In some embodiments, style definition 218 also specifies a callback routine that is defined in the native application and invoked at the appropriate time by rendering engine 212. In the example shown in FIG. 3, a callback routine labeled "draw game" is specified in style definition 218. As rendering engine 212 processes layout definition 216 to render content, it may encounter a command or data indicating a placeholder area 324 is to be reserved for a composite image. The rendering engine uses style definition 218 to obtain the display parameters for the placeholder area, including the callback routine. The rendering engine passes control to the callback routine in native application 210, which as discussed above, obtains any required parameters such as position, size and transparency parameters to be used. The native application then renders graphical components associated with the native application into the placeholder area 324 reserved for the native game image. After the callback routine in native application 210 has finished, control passes back to rendering engine 212 which continues rendering according to layout definition 216 and style definition 218.

Although FIGS. 1-3 describe some embodiments, the following sections describe many other features, embodiments, and further details on the operation of system 200.

Example Operations

This section describes operations associated with some embodiments of the invention. In the discussion below, the flow diagrams will be described with reference to the block diagrams presented above. However, in some embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments the operations can be performed in series, while in other embodiments, one or more of the operations can be performed in parallel. Moreover, some embodiments can perform less than all the operations shown in any flow diagram.

Figure 4:
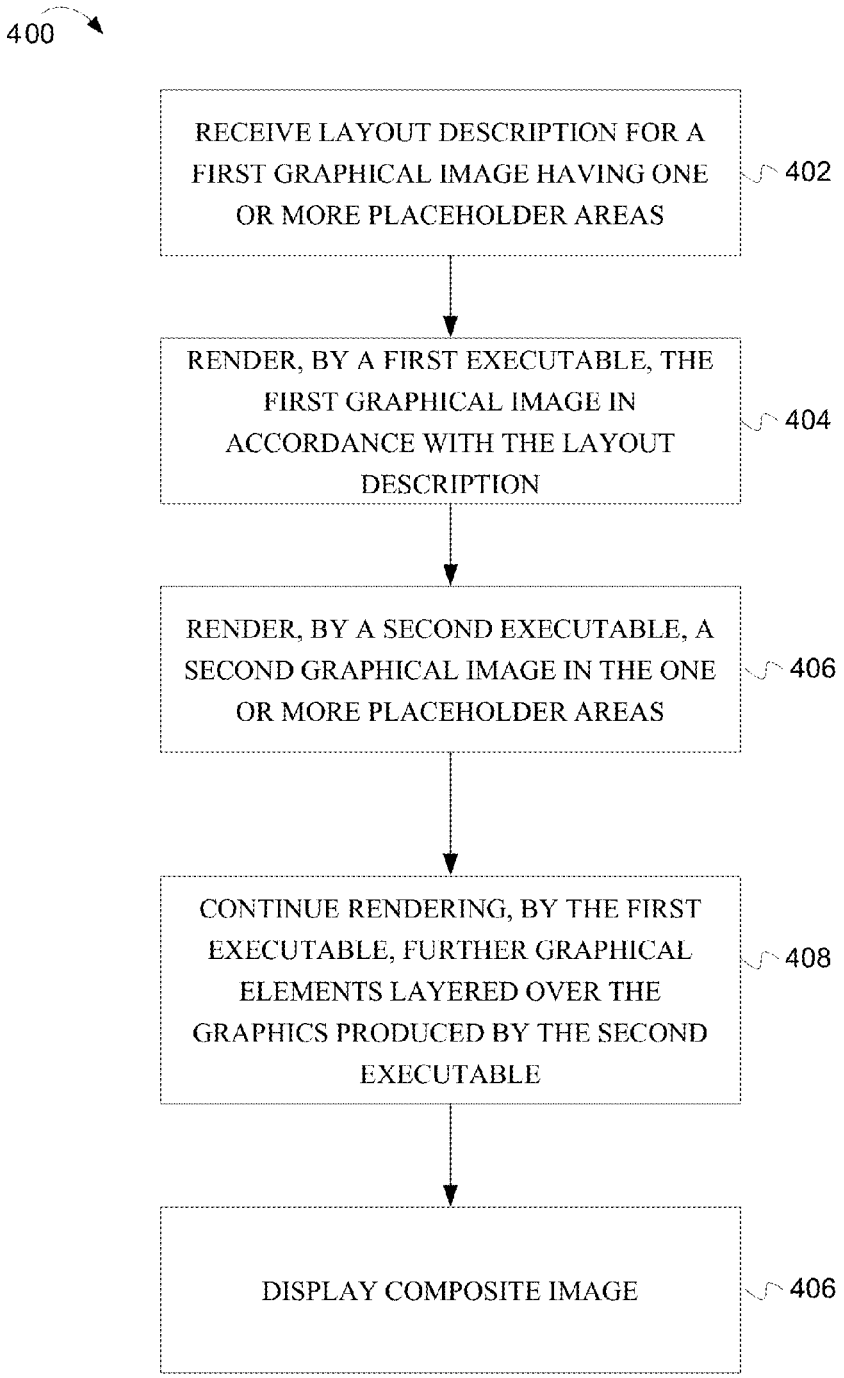
FIG. 4 is a flowchart illustrating a method for rendering graphical images using HTML elements as placeholders for native applications according to embodiments.

The section will discuss FIG. 4. The discussion of FIG. 4 will describe operations for rendering graphics within placeholders defined layout definition data.

FIG. 4 is a flowchart illustrating a method 400 for rendering graphical images using HTML elements as placeholders for native applications on a gaming machine. Method 400 begins at block 402 by receiving a layout description for a graphical image, where the layout description includes one or more placeholder areas. The layout description may describe a layout including various graphical elements such as backgrounds, icons, menus, text, video, image and other data associated with the presentation of games and applications on a wagering game machine. The layout description also specifies a layering or an ordering in which elements are displayed. As discussed above, the layout description includes one or more elements specifying placeholder areas. The layout description may specify that the placeholder areas are to be layered in between elements of the first graphical image. In some embodiments, the layout description is provided as HTML data and CSS data.

At block 404, the rendering engine renders the components of a first set of graphical components into a composite image as specified by a layout description and optionally a style definition. The rendering engine renders the first graphical image such that elements in the layout description that are specified as placeholder areas are left blank. In general, the first set of graphical components may be components that define a background image of a composite image.

At block 406, the rendering engine passes control to a second executable component such as a natively executed gaming application. The native application renders graphical components for a second graphical image into the one or more of the placeholder areas of the composite image. In some embodiments, the native application receives various display parameters such as the transparency, position and size of the place holder areas from the rendering engine. In alternative embodiments, the native application may read the layout description from the same source as the rendering engine and obtains the display parameters of the placeholder areas from the layout description.

At block 408, the rendering engine continues to render one or more elements of the first graphical image that may be layered over the placeholder areas, such that the image appears on top of the any background or other images rendered at block 404 and images rendered in any placeholder areas by other executable modules at block 406. The rendering engine may invoke and pass control to other presentation components such as Adobe Flash or Java components that produce graphical components for the composite image.

At block 410 the composite image comprising the elements defined by the layout definition and the graphics provided by the native application is displayed on a display 114 or 116 of wagering game machine 100.

FIGS. 5-8 are example screen images that will be to illustrate the operation of method 400.

Figure 5:
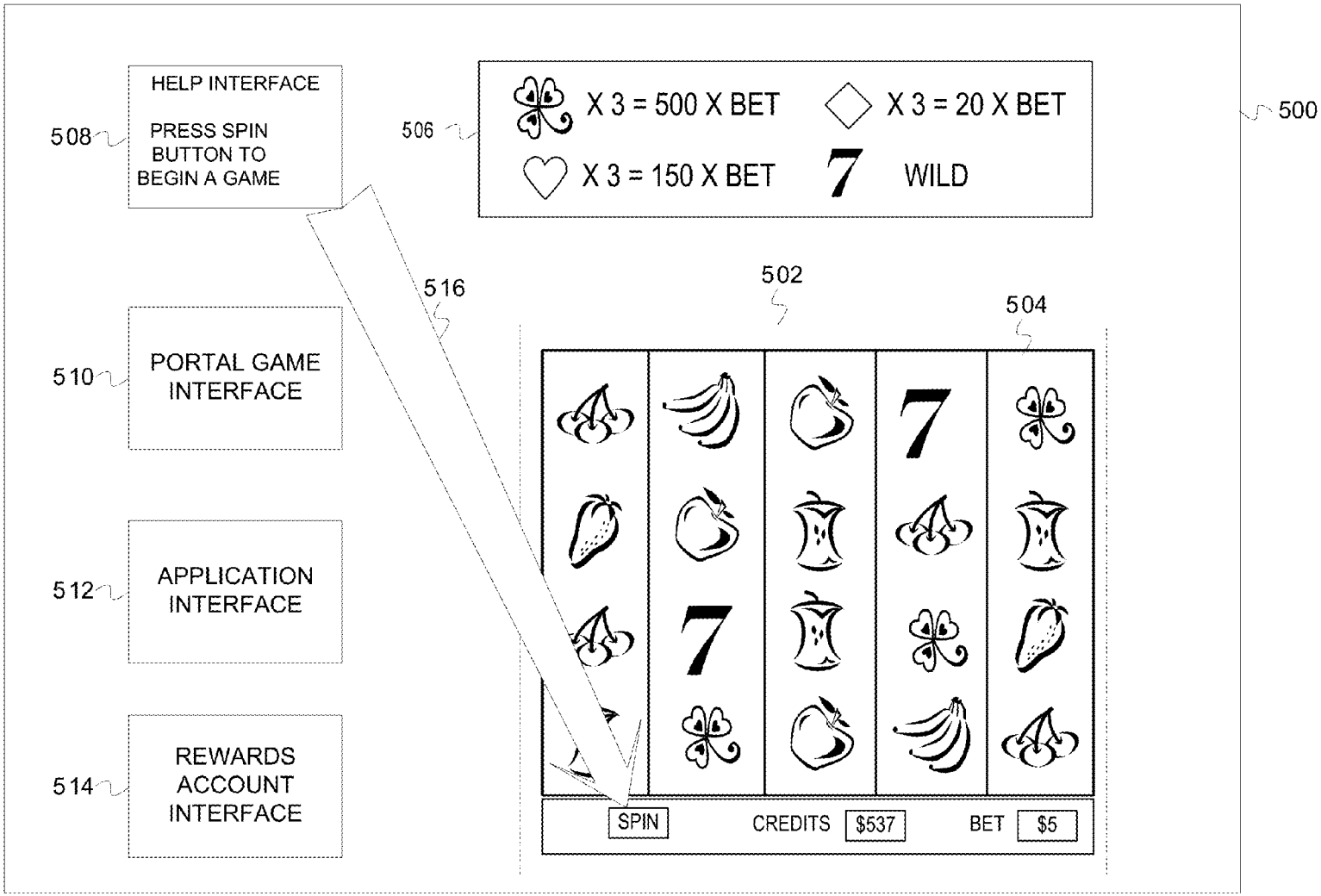
FIGS. 5-8 are example screen images used to illustrate the operation of method the method of FIG. 4.

FIG. 5 is an example screen image 500 that will be used to illustrate the operation of method 500 in the context of a hybrid graphical environment where graphical components are used to enhance a native application 210. Screen image 500 includes various components that may be displayed to a user of a wagering game machine via a display 114 or 116 on the wagering game machine. In the example shown in FIG. 5, screen image 500 includes a paytable 506, a help interface component 508, a portal game interface component 510, an application interface component 512, and a reward account interface component 512. Screen image 500 also includes a placeholder area 502 in which a native application 210 uses to display a wagering game.

During the operation of method 400, rendering engine 212 renders the various components as specified by the layout description. For example, rendering engine 212 may render a background image for screen image and other components such as paytable 506 that are to be rendered behind any application related images. Rendering engine 212 passes control to a native application, which in some embodiments, produces images 504 associated with a wagering game into a placeholder area 502. In the examples presented in FIGS. 5-8, a native application 210 is a slots based wagering game. Those of skill in the art having the benefit of the disclosure will appreciate that other wagering games or other applications may produce the images in a placeholder area 502. After native application 210 has finished rendering components into place holder area 502, rendering engine 212 continues to render and place graphical elements into the composite image forming example screen 500. For example, rendering engine 508 may render help interface 508 that provides useful information to a wagering game machine user about playing the game. In the example shown in FIG. 5, help interface 508 has been invoked to inform a player how to start a game. The help interface displays an arrow 516 to a "spin" button rendered by native application 210. Note that arrow 516 appears above the graphical components in the native application 210. This is an example where a native game can be enhanced using graphical components provided outside of the native game. Arrow 516 appears above the graphics 504 shown in placeholder area 502 because the rendering engine 212 was able to appropriately layer graphics produced by native application 210 using the inventive method described above. Those of skill in the art having the benefit of the disclosure will appreciate that other graphical components providing information such as help information, payout information, payline information or other enhancing graphics could be displayed.

Figure 6:
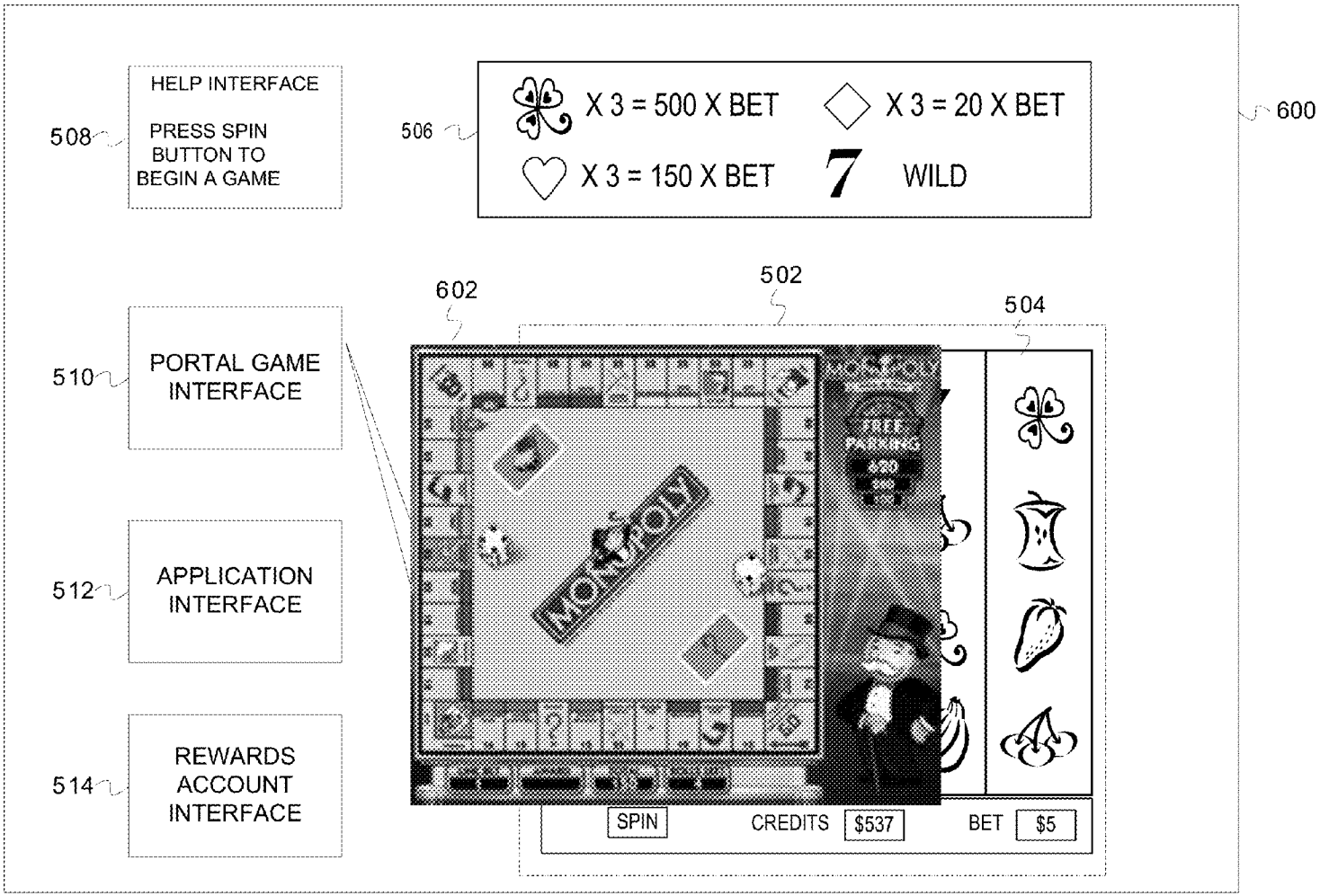

FIG. 6 illustrates an example screen image 600 that combines a native application 210 with an additional game such as a portal game or a bonus game. In the example shown, portal game interface 510 has been invoked allowing a wagering game machine user to play a portal game 602 in addition to a wagering game provided by native application 210. The portal game may be resident on the wagering game machine 100, or it may be selected using portal game interface 510 and downloaded from a content server 220.

It should be noted that other games besides portal games may be combined with games provided by a native application. For example, in some embodiments a bonus game may be triggered in a native application 210, and invoked and rendered using rendering engine 212. For example, the bonus game may be a Flash based of Java based game. Through the use of the placeholder areas provided by the inventive systems and methods described herein, the graphical images associated with a background, native application, and additional applications are layered properly.

The bonus game may communicate with native application 210. For example, the bonus game may obtain available credits, bet amounts or other information from native application 210 using standard interprocess communications mechanisms known in the art.

Figure 7:
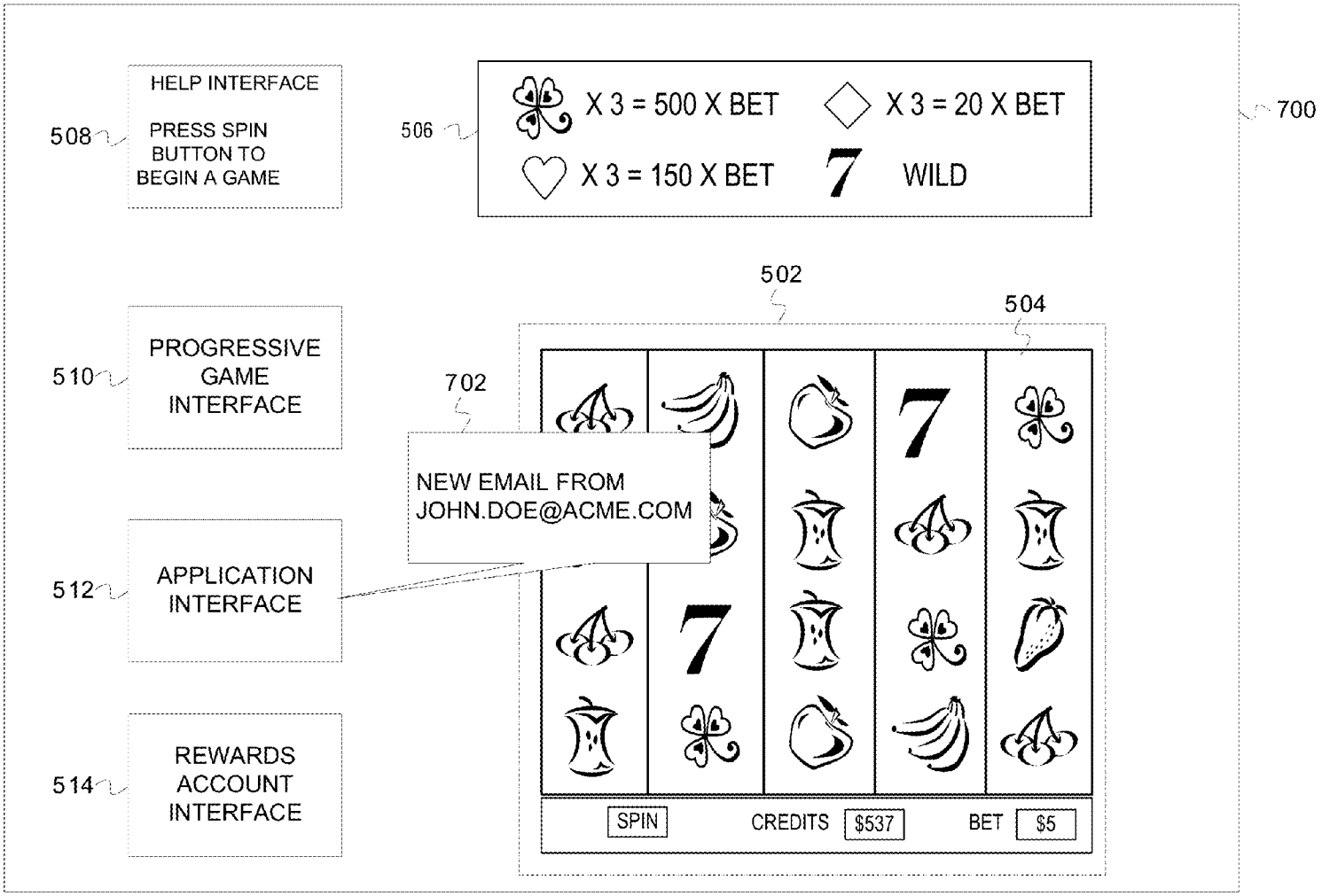

FIG. 7 illustrates an example screen image 700 that combines a native application 210 with an additional application such as an email application, information display application, reservation application etc. In the example shown, application interface 512 provides an interface to an email application allowing a user to send or receive emails while playing a game provided by native application 210. A popup interface 702 appears over the graphics produced by native application 210 informing the player that an email has arrived for them. The popup 702 appears appropriately layered over the graphics produced by native application 210 using the systems and methods described above.

Figure 8:
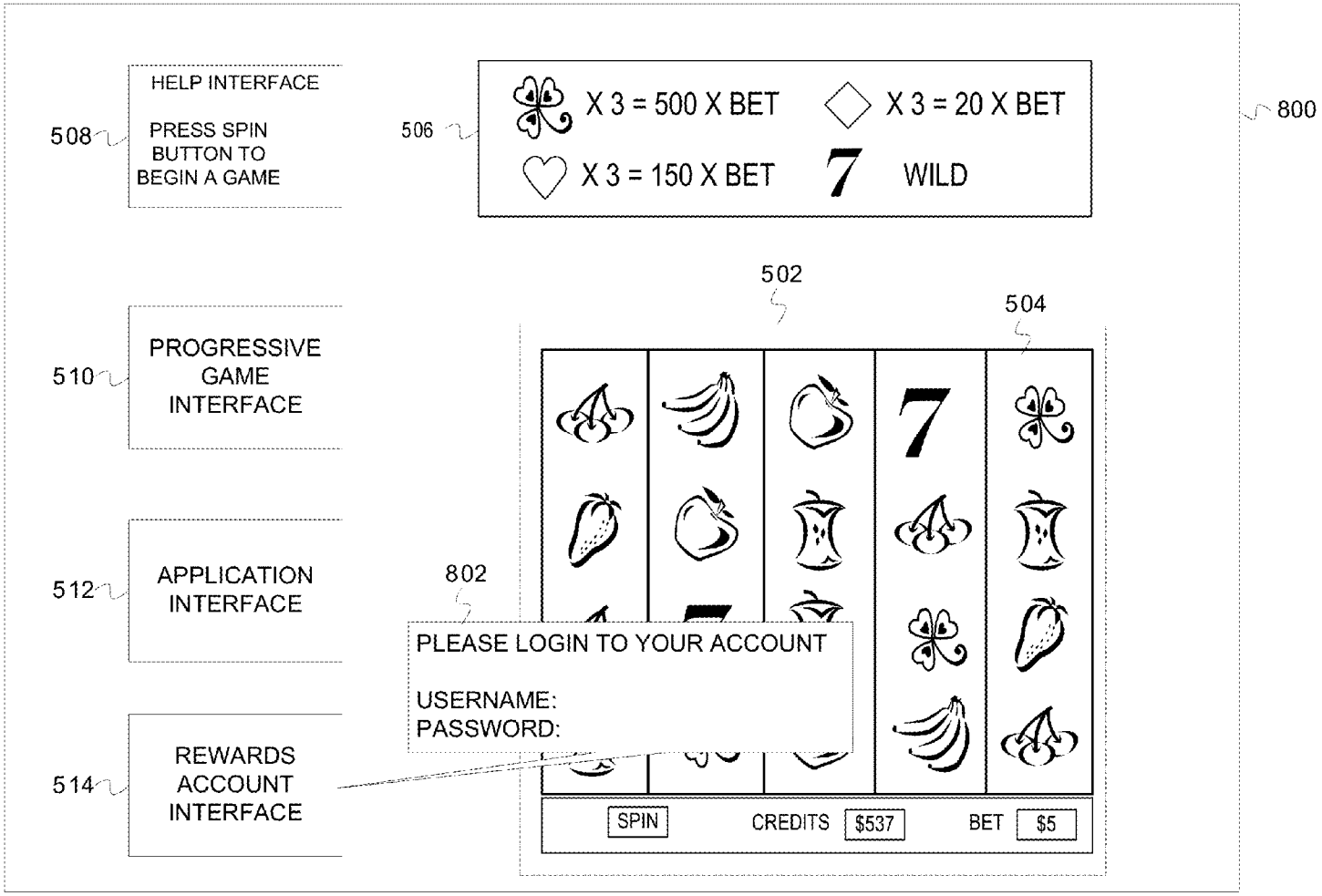

FIG. 8 illustrates an example screen image 800 that combines a native application 210 with a loyalty program interface 514. In general, a loyalty program provides rewards to players based on their play at wagering games within a particular casino or family of casinos provided by a casino operator. In the example illustrated in FIG. 8, loyalty program interface 414 provides a popup 802 prompting a player to login to their loyalty account using a user name and password combination. Other interface elements may provide a user with information such as their loyalty point balance, or may provide a popup when the loyalty balance crosses a significant threshold, such as amount that qualifies the player for a particular prize level. Again, the interface is properly layered over the graphics in the background and graphics provided by native application 210 using the systems and methods described above.

FIG. 9 illustrates an example layout language portion that declaratively specifies how elements are to appear in a wagering game and provides for default content should particular content not be available. In the example shown, a set of video components 902 that may be shown during the operation of a wagering game is provided. In the event that the video components are not available, or an appropriate decoder for the video is not available, then default or fallback content 904 may be provided.

It should be noted that other elements besides video may be specified. For example, layout and placement of symbol displays (reels, cards, bingo balls, etc.), payout tables, credit amounts, win amounts, bet amounts and other graphical components of a wagering game may be specified using a layout definition and a style definition.

From the above, it will be appreciated that the systems and methods of the inventive subject matter provide a mechanism for producing hybrid environments where a portion of the graphics on a wagering game machine may be provided using modern layout and style languages while other portions may be provided by legacy native application code. The systems and methods described herein provide appropriate layering and depth for both the graphical components specified in the layout language and the components provided by a native application.

Operating Environment

This section describes an example operating environment and presents structural aspects of some embodiments. This section includes discussion about wagering game machine architectures and wagering game networks.

Wagering Game Machine Architectures

FIG. 10 is a block diagram illustrating a wagering game machine architecture, according to example embodiments of the invention. As shown in FIG. 10, the wagering game machine architecture 1000 includes a wagering game machine 1006, which includes a central processing unit (CPU) 1026 connected to main memory 1028. The CPU 1026 can include any suitable processor, such as an Intel® Pentium processor, Intel® Core 2 Duo processor, AMD Opteron™ processor, or UltraSPARC processor. The main memory 1028 includes a wagering game unit 1032. In one embodiment, the wagering game unit 1032 can present wagering games, such as video poker, video black jack, video slots, video lottery, etc., in whole or part.

The CPU 1026 is also connected to an input/output (I/O) bus 1022, which can include any suitable bus technologies, such as an AGTL+ frontside bus and a PCI backside bus. The I/O bus 1022 is connected to a payout mechanism 1008, primary display 1010, secondary display 1012, value input device 1014, player input device 1016, information reader 1018, and storage unit 1030. The player input device 1016 can include the value input device 1014 to the extent the player input device 1016 is used to place wagers. The I/O bus 1022 is also connected to an external system interface 1024, which is connected to external systems 1004 (e.g., wagering game networks).

In one embodiment, the wagering game machine 1006 can include additional peripheral devices and/or more than one of each component shown in FIG. 10. For example, in one embodiment, the wagering game machine 1006 can include multiple external system interfaces 1024 and/or multiple CPUs 1026. In one embodiment, any of the components can be integrated or subdivided.

Any component of the architecture 1000 can include hardware, firmware, and/or machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable storage media includes read only memory (ROM), random access memory (RAM), magnetic disk storage media, optical storage media, flash memory machines, etc. Machine-readable media also includes signal media comprising any media suitable for transmitting software over a network.

While FIG. 10 describes an example wagering game machine architecture, this section continues with a discussion wagering game networks.

Wagering Game Networks

Figure 11:
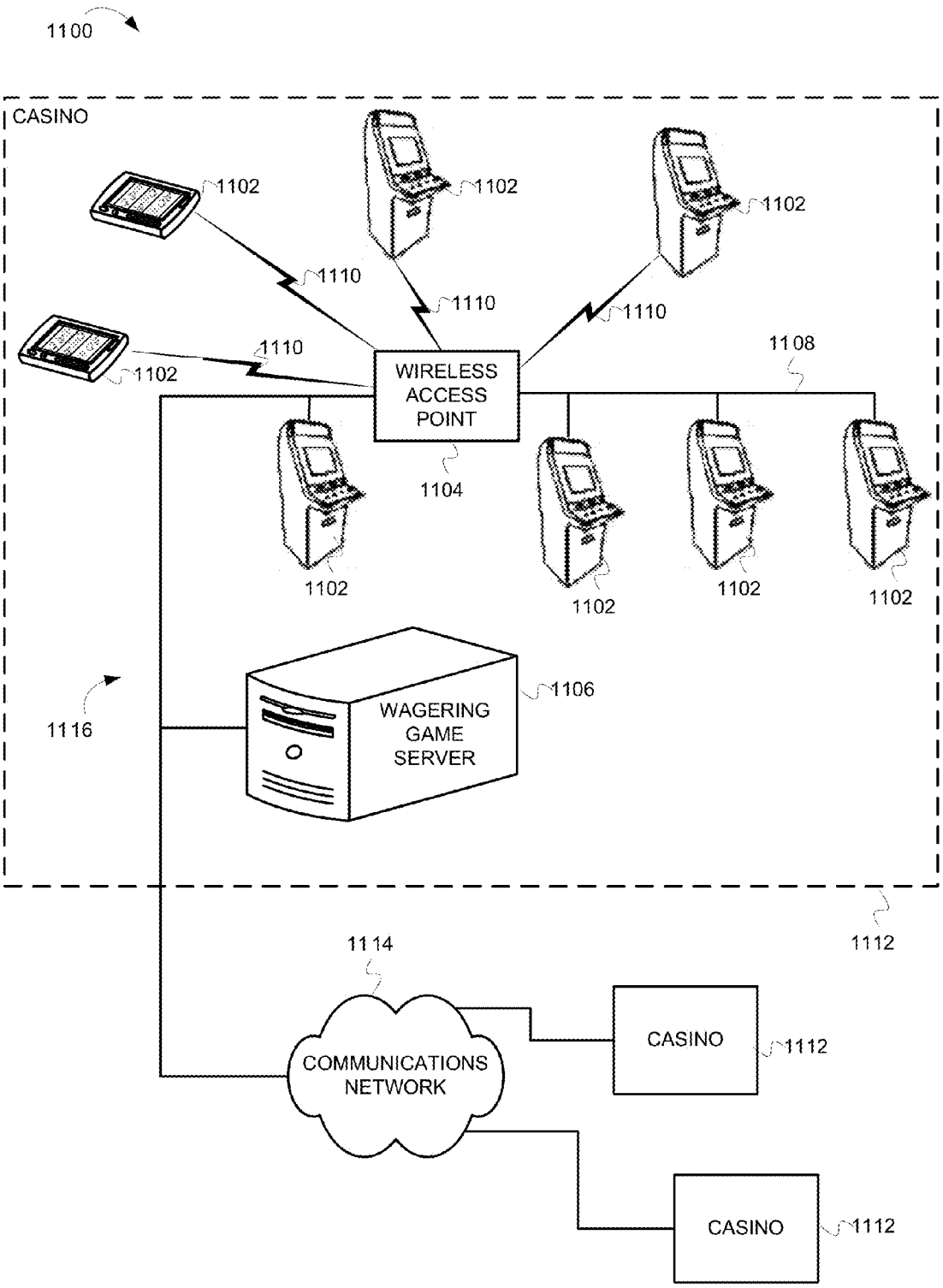
FIG. 11 is a block diagram illustrating a wagering game network, according to example embodiments of the invention

FIG. 11 is a block diagram illustrating a wagering game network 1100, according to example embodiments of the invention. As shown in FIG. 11, the wagering game network 1100 includes a plurality of casinos 1112 connected to a communications network 1114.

Each casino 1112 includes a local area network 1116, which includes an access point 1104, a wagering game server 1106, and wagering game machines 1102. The access point 11304 provides wireless communication links 1110 and wired communication links 1108. The wired and wireless communication links can employ any suitable connection technology, such as Bluetooth, 802.11, Ethernet, public switched telephone networks, SONET, etc. In some embodiments, the wagering game server 1106 can serve wagering games and distribute content to devices located in other casinos 1112 or at other locations on the communications network 1114.

The wagering game machines 1102 described herein can take any suitable form, such as floor standing models, handheld mobile units, bartop models, workstation-type console models, etc. Further, the wagering game machines 1102 can be primarily dedicated for use in conducting wagering games, or can include non-dedicated devices, such as mobile phones, personal digital assistants, personal computers, etc. In one embodiment, the wagering game network 1100 can include other network devices, such as accounting servers, wide area progressive servers, player tracking servers, and/or other devices suitable for use in connection with embodiments of the invention.

In some embodiments, wagering game machines 1102 and wagering game servers 1106 work together such that a wagering game machine 1102 can be operated as a thin, thick, or intermediate client. For example, one or more elements of game play may be controlled by the wagering game machine 1102 (client) or the wagering game server 1106 (server). Game play elements can include executable game code, lookup tables, configuration files, game outcome, audio or visual representations of the game, game assets or the like. In a thin-client example, the wagering game server 1106 can perform functions such as determining game outcome or managing assets, while the wagering game machine 1102 can present a graphical representation of such outcome or asset modification to the user (e.g., player). In a thick-client example, the wagering game machines 1102 can determine game outcomes and communicate the outcomes to the wagering game server 1106 for recording or managing a player's account.

In some embodiments, either the wagering game machines 1102 (client) or the wagering game server 1106 can provide functionality that is not directly related to game play. For example, account transactions and account rules may be managed centrally (e.g., by the wagering game server 1106) or locally (e.g., by the wagering game machine 1102). Other functionality not directly related to game play may include power management, presentation of advertising, software or firmware updates, system quality or security checks, etc.

Any of the wagering game network components (e.g., the wagering game machines 1102) can include hardware and machine-readable media including instructions for performing the operations described herein.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A method for presenting a graphical display on a wagering game machine, the wagering game machine primarily dedicated to playing at least one natively executed casino wagering game, the wagering game machine including an electronic display device and a plurality of electronic input devices, the method comprising:

receiving by one or more processors a layout description for a first set of image components, the layout description defining one or more placeholder areas;

detecting, via a first electronic input device of the plurality of electronic input devices, a physical item associated with a monetary value that establishes a credit balance;

initiating the at least one natively executed casino wagering game in response to an input received from a second electronic input device of the plurality of electronic input devices, the input indicative of a wager covered by the credit balance;

rendering, by a first executable component, a first portion of the first set of image components in accordance with the layout description;

rendering within the one or more placeholder areas by the at least one natively executed casino wagering game a second set of image components, the second set of image components defined independently of the layout description;

rendering, by the first executable component, a second portion of the first set of image components over the second set of image components;

displaying on the electronic display device the rendered first and second set of image components; and receiving, via a third electronic input device of the plurality of electronic input devices, a cashout input that initiates a payout from the credit balance.

2. The method of claim 1, and further comprising receiving, by the at least one natively executed casino wagering game, display parameters associated with a size and position of the one or more placeholder areas.

3. The method of claim 1, wherein the first executable component comprises a rendering engine.

4. The method of claim 1, wherein the layout description comprises an HTML file or a CSS file.

5. The method of claim 1, wherein rendering, by the at least one natively executed casino wagering game, is in response to a callback routine specified in the layout description.

6. The method of claim 1, and further comprising invoking, by the first executable component, a third executable component for providing graphical content.

7. The method of claim 6, wherein the third executable component comprises an Adobe Flash component.

8. The method of claim 6, wherein the at least one natively executed casino wagering game communicates with the third executable component.

9. A system for presenting a graphical display on a wagering game machine primarily dedicated to playing at least one casino wagering game, the system comprising:

a plurality of electronic input devices;

one or more processors coupled to the plurality of electronic input devices, the one or more processors configured to detect, via at least a first electronic input device of the plurality of electronic input devices, a physical item associated with a monetary value that establishes a credit balance;

an electronic display device coupled to the one or more processors;

a layout description for a first set of image components, the layout description defining one or more placeholder areas;

a rendering engine executable by the one or more processors and configured to render a first portion of the first set of image components in accordance with the layout description; and a natively executed wagering game application configured to render within the one or more placeholder areas a second set of image components, the second set of image components defined independently of the layout description, wherein the natively executed wagering game application presents the at least one casino wagering game and initiates the casino wagering game in response to an input received via a second electronic input device of the plurality of electronic input devices, the input indicative of a wager covered by the credit balance;

wherein the rendering engine is further configured to render a second portion of the first set of image components over the second set of image components; and wherein the system is configured to receive, via a third electronic input device of the plurality of electronic input devices, a cashout input that initiates a payout from the credit balance.

10. The system of claim 9, wherein the natively executed wagering game application is further configured to receive display parameters associated with a size and position of the one or more placeholder areas.

11. The system of claim 9, wherein the layout description comprises an HTML file or a CSS file.

12. The system of claim 9, wherein rendering, by the natively executed wagering game application, is in response to a callback routine specified in the layout description.

13. The system of claim 9, and further comprising a presentation component invoked by the rendering engine and configured to provide graphical content.

14. The system of claim 13, wherein the presentation component comprises an Adobe Flash component.

15. The system of claim 13, wherein the natively executed wagering game application is configured to communicate with the presentation component.

16. A non-transitory machine-readable medium having machine executable instructions stored thereon for causing one or more processors, that when executed, perform operations for presenting a graphical display on a wagering game machine, the wagering game machine primarily dedicated to playing at least one natively executed casino wagering game, the wagering game machine including an electronic display device and a plurality of electronic input devices, the operations comprising:

receiving by one or more processors a layout description for a first set of image components, the layout description defining one or more placeholder areas;

detecting, via a first electronic input device of the plurality of electronic input devices, a physical item associated with a monetary value that establishes a credit balance;

initiating the at least one natively executed casino wagering game in response to an input received via a second electronic input device of the plurality of electronic input devices, the input indicative of a wager covered by the credit balance;

rendering, by a first executable component, a first portion of the first set of image components in accordance with the layout description;

rendering within the one or more placeholder areas by the at least one natively executed casino wagering game a second set of image components, the second set of image components defined independently of the layout description;

rendering, by the first executable component, a second portion of the first set of image components over the second set of image components;

displaying the rendered first and second set of image components on the electronic display device; and receiving, via a third electronic input device of the plurality of electronic input devices, a cashout input that initiates a payout from the credit balance.

17. The non-transitory machine-readable medium of claim 16, wherein the operations further comprise receiving, by the at least one natively executed casino wagering game, display parameters associated with a size and position of the one or more placeholder areas.

18. The non-transitory machine-readable medium of claim 16, wherein the first executable component comprises a rendering engine.

19. The non-transitory machine-readable medium of claim 16, wherein the layout description comprises an HTML file or a CSS file.

20. The non-transitory machine-readable medium of claim 16, wherein rendering, by the at least one natively executed casino wagering game, is in response to a callback routine specified in the layout description.

21. The non-transitory machine-readable medium of claim 16, wherein the operations further comprise invoking, by the first executable component, a third executable component for providing graphical content.

22. The non-transitory machine-readable medium of claim 21, wherein the third executable component comprises an Adobe Flash component.

23. The non-transitory machine-readable medium of claim 21, wherein the at least one natively executed casino wagering game communicates with the third executable component.

24. The method of claim 1, wherein one or more of the first electronic input device, the second electronic input device and the third electronic input device comprise buttons on a touch screen.

25. The system of claim 9, wherein the electronic display device includes a touch screen, and wherein one or more of the first electronic input device, the second electronic input device and the third electronic input device comprise buttons on the touch screen.

26. The machine-readable medium of claim 21, wherein one or more of the first electronic input device, the second electronic input device and the third electronic input device comprise buttons on a touch screen.

* * * * *